US006467094B1

(12) United States Patent
Najarian

(10) Patent No.: US 6,467,094 B1
(45) Date of Patent: Oct. 22, 2002

(54) NECKTIE KNOT SUPPORT ASSEMBLY

(75) Inventor: John Najarian, Old Tappan, NJ (US)

(73) Assignee: Eastern Creative Industries, Inc., Closter, NJ (US)

( * ) Notice: Subject to any disclaimer, the term of this patent is extended or adjusted under 35 U.S.C. 154(b) by 0 days.

(21) Appl. No.: 10/084,847

(22) Filed: Feb. 26, 2002

(51) Int. Cl.[7] ..... A41D 25/08
(52) U.S. Cl. ..... 2/152.1; 2/153; 2/150
(58) Field of Search ..... 2/152.1, 145, 156, 2/155, 144, 146, 148, 153, 150

(56) References Cited

U.S. PATENT DOCUMENTS

| | | | | | |
|---|---|---|---|---|---|
| 414,406 | A | * | 11/1889 | Hanford | 2/153 |
| 2,798,226 | A | * | 7/1957 | Kanter | 2/153 |
| 3,173,149 | A | | 3/1965 | Cosgrove | |
| 3,220,015 | A | * | 11/1965 | Kanter et al. | 2/153 |
| 3,221,343 | A | | 12/1965 | Phillips et al. | |
| 3,222,684 | A | * | 12/1965 | Kanter et al. | 2/153 |
| 3,237,208 | A | * | 3/1966 | Kanter et al. | 2/153 |
| 3,336,600 | A | * | 8/1967 | Kanter et al. | 2/153 |
| 3,336,601 | A | * | 8/1967 | Kanter et al. | 2/153 |
| 3,343,176 | A | * | 9/1967 | Kanter et al. | 2/153 |
| 3,365,726 | A | | 1/1968 | Pulitzer | |
| 3,426,361 | A | | 2/1969 | Ellin | |
| 3,513,483 | A | | 5/1970 | Kanter et al. | |
| 3,820,166 | A | | 6/1974 | Gouner | |
| 4,337,539 | A | * | 7/1982 | Najarian | 2/153 |
| D267,289 | S | | 12/1982 | Najarian | |
| 4,489,443 | A | * | 12/1984 | Ellin | 2/153 |
| 4,748,692 | A | * | 6/1988 | Fukushima | 2/152 |
| 4,897,887 | A | | 2/1990 | Chen et al. | |
| 4,995,118 | A | * | 2/1991 | Paduano, Sr. | 2/150 |
| 5,084,916 | A | | 2/1992 | Austin | |
| 5,505,351 | A | | 4/1996 | Najarian | |
| 5,584,075 | A | * | 12/1996 | Bae et al. | 2/152.1 |
| 6,021,522 | A | * | 2/2000 | Najarian | 2/153 |

* cited by examiner

*Primary Examiner*—John J. Calvert
*Assistant Examiner*—Alissa L. Hoey
(74) *Attorney, Agent, or Firm*—Cowan, Liebowitz & Latman, P.C.; Mark Montague

(57) ABSTRACT

A necktie knot support assembly for supporting a pre-tied knotted necktie includes a spring clamp adapted to engage a shirt collar, and a main body member shaped to determine formation of the knot of the necktie. The main body member has a vertical central wall and first and second wings that extend outward from the central wall. The central wall includes a slotted arm that extends across the central wall and that inter-engages and retains the spring clamp. The central wall has a notch positioned so that a shirt button on the shirt collar is disposed within the notch during engagement of the spring clamp to the shirt collar. Another notch is disposed within the forward portion of the central wall to facilitate the connection of the spring clamp and the main body member at a substantial angle.

14 Claims, 2 Drawing Sheets

NECKTIE KNOT SUPPORT ASSEMBLY

BACKGROUND OF THE INVENTION

The present invention relates to improvements in necktie knot support assemblies.

Pre-tied neckties have been available for many decades. Such neckties provided with a spring clamp for firmly grasping the shirt neck band have also been used as well as patented for several decades. Earlier designs are disclosed in the following U.S. Pat. Nos. 2,798,226; 3,220,015; 3,222,684; 3,237,208; 3,336,600; 3,336,601 and 3,343,176. More modern pre-tied neckties are disclosed in U.S. Pat. No. 4,337,539 and U.S. Pat. No. 6,021,522, which are incorporated herein by reference.

Generally, pre-tied neckties have the drawback that they present a knot that sags inward towards the wearer's neck. This sag is an undesirable indication that the wearer is wearing a pre-tied necktie, which is more commonly known as clip-on tie.

OBJECTS AND SUMMARY OF THE INVENTION

It is therefore an object of the present invention to provide a necktie knot support assembly which overcomes the above-stated drawback of existing designs.

It is another object of the present invention to provide a necktie knot support assembly with various features that accommodate a shirt collar's button to further enhance the appearance of the pre-tied necktie.

In accordance with the present invention, a necktie knot support assembly for supporting a pre-tied knotted necktie includes a spring clamp adapted to engage a shirt collar, and a main body member shaped to determine formation of the knot of the necktie. The main body member has a vertical central wall and first and second wings that extend outward from the central wall. The central wall includes a slotted arm that extends across the central wall and that inter-engages and retains the spring clamp. The central wall has a notch positioned so that a shirt button on the shirt collar is disposed within the notch during engagement of the spring clamp to the shirt collar.

As an aspect of the invention, the notch is disposed within an upper portion of the central wall of the main body member.

As another aspect of the invention, the main body member includes a post rearwardly extending outwards from the central wall at a position disposed below the notch.

As a further aspect of the invention, the slotted arm is U-shaped that extends across the front of the central wall to define at least a portion of the notch.

As an addition aspect of the invention, the spring clamp includes a clamp arm and legs swingably attached to the clamp arm, and the slotted arm of the main body member represents an inner slotted arm extending across the central wall. The main body member also includes an outer slotted arm that extends across the central wall disposed below the inner slotted arm, and a gap is disposed between the inner and outer slotted arms for receiving the legs of the spring clamp. The inner slotted arm extends forward from the central wall and the outer slotted arm is appropriately positioned from the central wall so that the legs of the spring clamp are disposed relative to the central wall by an angle substantially between 10 and 40 degrees.

As yet a further aspect of the invention, the central wall of the main body member includes a second notch that is disposed within the front of the central wall and is appropriately positioned so that the spring clamp is retained by the slotted arm at an angle relative to the central wall substantially between 10 and 40 degrees.

As yet another aspect of the invention, the first and second wings include respective flat inner walls that extending from the central wall at positions sufficiently separated from one another to allow the shirt button on the shirt collar to be disposed between those positions.

BRIEF DESCRIPTION OF THE DRAWINGS

The following detailed description, given by way of example and not intended to limit the present invention solely thereto, will best be appreciated in conjunction with the accompanying drawings, wherein like referenced numerals denote like elements and parts, in which.

DETAILED DESCRIPTION OF THE PRESENT INVENTION

Figure 1:
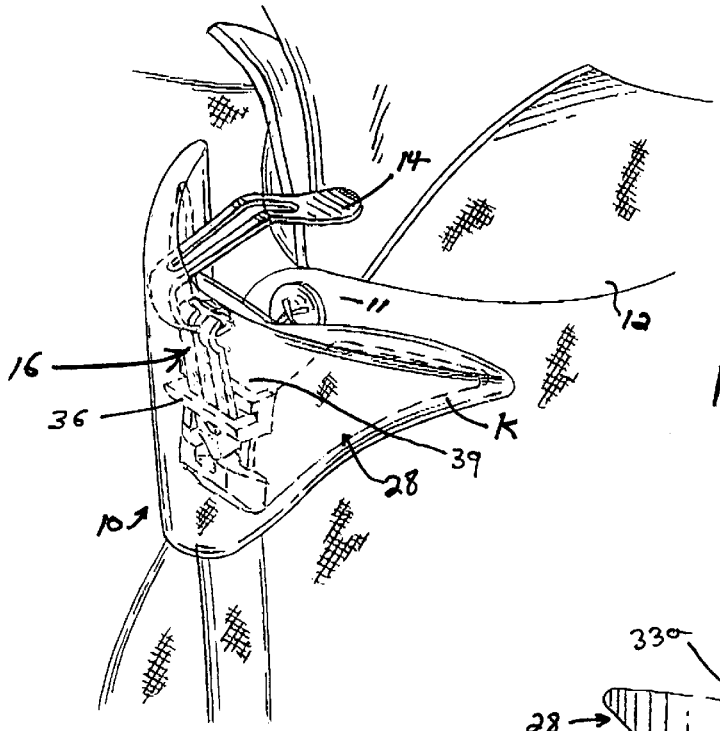
FIG. 1 is a front perspective view of a completely pre-tied necktie, the hidden portion of the necktie knot support assembly of the present invention shown in phantom, the lower fabric of the necktie being partly broken away, illustrating the application to a shirt neck band.

Referring now to the drawings, FIGS. 1–8 illustrate a necktie knot support assembly in accordance with the present invention. Referring first to FIG. 1, a fully assembled pre-tied necktie 10, partially broken away at its bottom end, is illustrated. A formed knot K is attachable to and releasable from a neck band 11 of a shirt collar 12, the shirt collar being illustrated as being lifted for purposes of clarity, although normally it remains in the conventional downward, wearing position. Necktie 10 is applied to neck band 11 by a swingable clamp arm 14 which forms the upper portion of a spring clamp 16 (shown in phantom in FIG. 1).

Figure 4:
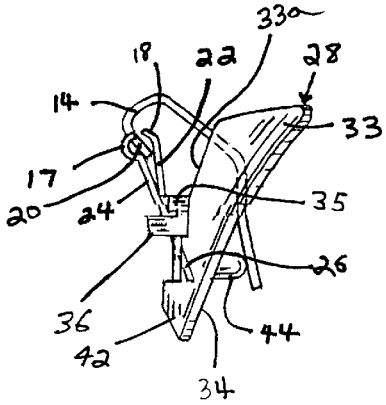
FIG. 4 is a side elevational view of the knot support assembly.
Figure 5:
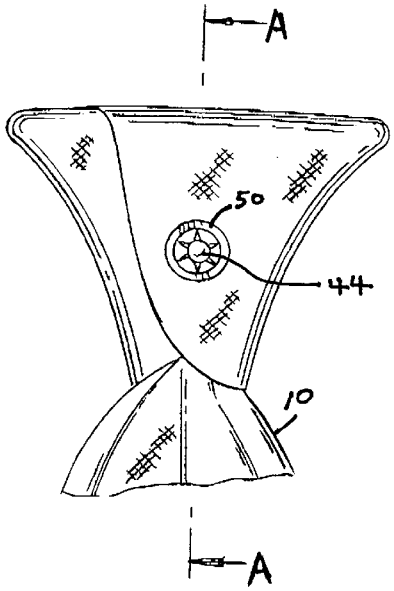
FIG. 5 is a rear elevational view of the completed pre-tied necktie, the lower fabric of the necktie being partly broken away.
Figure 6:
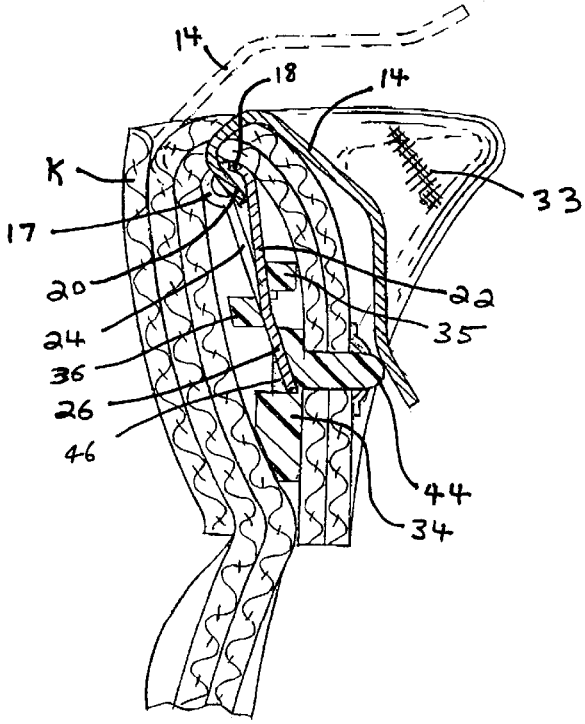
FIG. 6 is a cross section, side elevational view taken along the line A—A of FIG. 5 of a completely pre-tied necktie, the lower fabric of the necktie being partly broken away.

Referring to FIGS. 2, 4, 6 and 7, the upper portion of spring clamp 16 includes two forward concave knuckles 17, a rearward central knuckle 18, and a rectangular cross bar 20 that is integral with and forms the extreme inner end of clamp arm 14. These elements enable the pivotal (or swingable) ability of clamp arm 14 in a vertical plane since cross bar 20 is received between knuckles 17 and 18, as best shown in FIG. 4. FIG. 6 illustrates clamp arm 14 in both the open position (clamp arm 14 shown in dashed lines) and the closed position (clamp arm 14 shown in solid lines).

Figure 7:
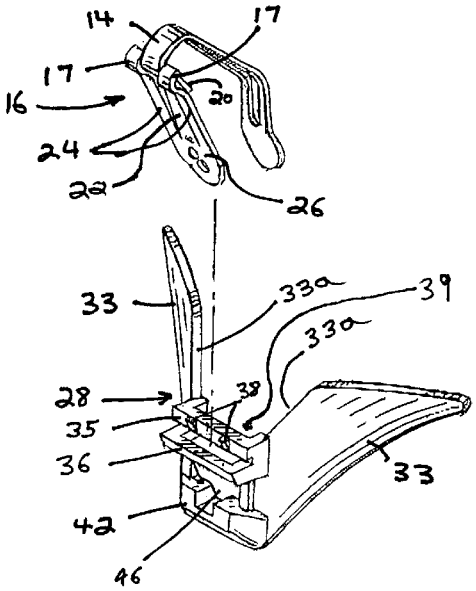
FIG. 7 is an exploded perspective view of the knot support assembly.

As best shown in the top half of the exploded view of FIG. 7, cross bar 20 is integral with an inner leg 22 that extends downward, and each of the two concave knuckles 17 is integral with respective outer legs 24 also extending downward. The two outer legs 24 and the inner leg 22 come together at the spring clamp's bottom end or apex 26. FIG. 6 also shows outer legs 24 and inner leg 22 coming together at apex 26. Spring clamp 16 is substantially similar to the spring clamp shown and described in U.S. Pat. No. 4,337,539.

The present invention substantially differs from that disclosed in the patents previously mentioned in the design of its main body member 28, which is shown in FIGS. 2–4 and 7–8, and shown in phantom in FIG. 1, and partially shown in cross-section in FIG. 6. In accordance with the present invention, body member 28 comprises a number of features that, when coupled to spring clamp 16, provides a knot that is balanced better as compared to prior designs, thus creating an upper tilt of the knot. As is appreciated, prior designs give the tie clip wearer a downward, sagging knot, which is more representative of the appearance of pre-tied neckties.

Figure 3:
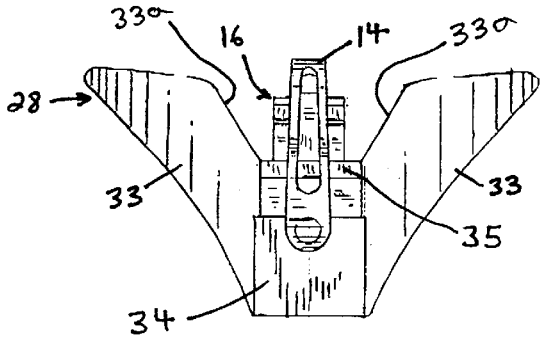
FIG. 3 is a rear elevational view thereof.
Figure 2:
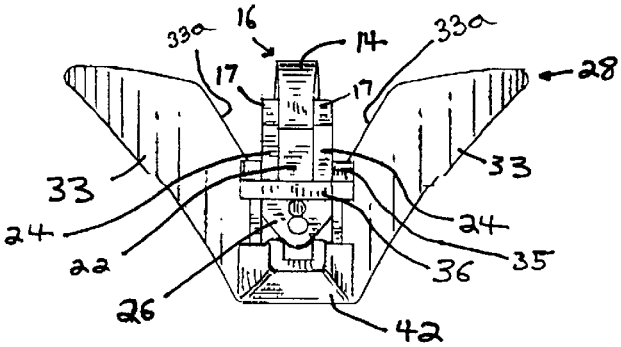
FIG. 2 is a front elevational view of the knot support assembly in accordance with the present invention.
Figure 8:
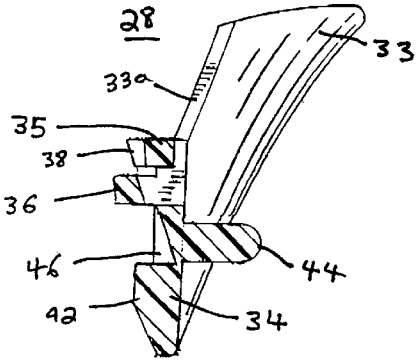
FIG. 8 is a side elevational view of one component of the necktie knot support assembly.

Referring particularly to FIGS. 2–4 and 8, as well as to the lower portion of the exploded view of FIG. 7, body member 28 is shown to include rearwardly directed side wings 33 that extend upward. The side wings 33 are connected by a central, relatively flat integral central bridging wall 34, and as further discussed below, wall 34 are devised to cooperate with spring clamp 16 (see FIG. 4). The inner walls 33*a* of side wings 33 are substantially straight as they extend away from the central portion of the body member, as best shown in FIGS. 2, 3 and 8. As previously mentioned, bridging (or central) wall 34 extends between the two wings 33, with such bridging wall 34 being disposed on the lower portion of the central section of body member 28, as best shown in FIGS. 3 and 8. As best shown in FIG. 7, an inner slotted arm 35 and an outer slotted arm 36 are integral with and extend between the front surfaces of wings 33, with the inner and outer slotted arms 35 and 36 being disposed above bridging wall 34 within the central portion of body member 28 (also shown in FIG. 8). A space or gap is formed between the inner and outer slotted arms 35 and 36 for receiving spring clamp 16, as shown in FIG. 7. Two molded integral short projections 38 (shown in FIGS. 7 and 8) extend from inner slotted arm 35 and serve to press against outer legs 24 of spring clamp 16 when the clamp is inserted into position (see FIG. 4). Projections 38 are horizontally spaced.

As previously mentioned, both inner and outer slotted arms 35 and 36 extend from the front surfaces of portions of the two wings 33 so that a notch 39 is provided between wings 33, disposed immediately above the upper surface of bridging wall 34, shown in FIG. 7 and in phantom in FIG. 1 (and schematically illustrated in FIGS. 6 and 8).

Body member 28 also includes, integrally formed therewith, a U-shaped ridge 42 at the lower surface of bridging wall 34, and as will be appreciated, ridge 42 limits downward movement of spring clamp 16 after its insertion into position. Body member 28 further includes a rear post 44 that extends from the upper portion of bridging wall 34, as shown in FIGS. 6 and 8, and post 44 serves to urge the formed knot in an elevated manner, as in prior art designs.

In accordance with the present invention and as previously mentioned, inner walls 33*a* of side wings 33 are substantially straight. Moreover, inner walls 33*a* terminate at respective ends of inner slotted arm 35 (see FIG. 3). This design along with the extension of inner and outer slotted arms 35 and 36 from the front surfaces of side wings 33 provide for the existence of notch 39 disposed above bridging wall 34. The existence of notch 39 as well as the straightness of inner walls 33*a* provide for an opening in the present invention that does not exist in prior designs, with such opening advantageously allowing the shirt collar button to meet the clip (during use of the present invention by a wearer) which in turn allows the upper loop of the lever, that is, knuckles 17 and 18, to sit in the collar yoke at the uppermost end that is attached to the spring clamp. Such positioning serves to balance the knot better thereby creating an upper tilt of the knot while being worn by a wearer. In contrast to this result, prior designs do not provide space for the collar button, thus not permitting the above-mentioned balancing from occurring, which in turns results in the loop of the spring clamp to be disposed noticeably lower on the shirt collar, as compared to the present design. This result in positioning in turn does not result in the above-mentioned balancing thereby providing the tie clip wearer with a downward, sagging knot.

Returning to the drawings, and particularly to FIGS. 4, 6, 7 and 8, inner slot arm 35 is disposed between wings 33 at a position that it is extended away (forwardly) from the central portion of body member 28 (best shown in FIG. 8). As shown in FIG. 8, a notch 46 is provided immediately above U-shaped ridge 42 so that when spring clamp 16 is installed within body member 28, the spring clamp's apex 26 is disposed within notch 46 and is prevented from moving further downward by ridge 42, as best shown in FIG. 6. Since inner slotted arm 35 extends forwardly from a central plane defined by bridging wall 34, along with the existence of notch 46, spring clamp 16 when installed is disposed in a position relative to body member 28 so that outer legs 24 of spring clamp 16 extend along a plane that is offset by a substantial angle from the plane defined by the relatively flat surface of bridging wall 34 (i.e., the surface from which post 44 extends). This angle is best illustrated in FIGS. 4 and 6. This angle, which may be between ten degrees and 40 degrees based on the particular construction of the spring clamp and body member of the present invention, results in an upward lift of the lower portion of body member 28 while the clip-on tie is being worn by a wearer, such upward lift providing the lower portion of the knot (FIG. 1) being disposed away from the wearer, as is the case with ties properly worn without clip-on components. As compared to prior designs that do not include any appreciable angle of separation between the central plane of the body member and that of the spring clamp, such as the design shown in U.S. Pat. No. 4,337,539, the present invention provides the previously mentioned so-called lift to an extent not realized by such prior designs. It is noted and appreciated that U.S. Pat. No. 6,021,522, owned by the applicant of the present invention, discloses a design that achieves the previously mentioned "lift" of the tie by utilization of a pair of nose projections, a design completely different from that disclosed herein.

While the present invention has been particularly shown and described in conjunction with a preferred embodiment thereof, it will be readily appreciated by those of ordinary skill in the art that various changes may be made without departing from the spirit and scope of the invention. For example, different latch mechanisms other than the spring latch shown may be used by the body member shown.

Therefore it is intended that the appended claims be interpreted as including the embodiment described herein, any alternatives mentioned above, and all equivalents thereto.

What is claimed is:

1. A necktie knot support assembly for supporting a pre-tied knotted necktie, said assembly comprising:

a spring clamp adapted to engage a shirt collar; and a main body member shaped to determine formation of the knot of the necktie, the main body member having a substantially vertical central wall and first and second wings extending outward from the central wall; said central wall having a slotted arm extending across the central wall and adapted to inter-engage and retain the spring clamp; the central wall having a notch and positioned within the central wall so that a shirt button on the shirt collar is disposed within the notch during engagement of the spring clamp to the shirt collar; the notch being disposed within an upper portion of the central wall of the main body member.

2. A necktie knot support assembly for supporting a pre-tied knotted necktie, said assembly comprising:

a spring clamp adapted to engage a shirt collar; and a main body member shaped to determine formation of the knot of the necktie, the main body member having a substantially vertical central wall and first and second wings extending outward from the central wall; said central wall having a slotted arm extending across the central wall and adapted to inter-engage and retain the spring clamp; the central wall having a notch and positioned within the central wall so that a shirt button on the shirt collar is disposed within the notch during engagement of the spring clamp to the shirt collar; the main body member including a post rearwardly extending outwards from the central wall at a position disposed below the notch.

3. The assembly of claim 2, wherein the slotted arm of the main body member is a U-shaped arm extending across a front of the central wall to define at least a portion of the notch.

4. A necktie knot support assembly for supporting a pre-tied knotted necktie, said assembly comprising:

a spring clamp adapted to engage a shirt collar, the spring clamp including a clamp arm and legs swingably attached to the clamp arm; and a main body member shaped to determine formation of the knot of the necktie, the main body member having a substantially vertical central wall and first and second wings extending outward from the central wall; said central wall having a slotted arm extending across the central wall and adapted to inter-engage and retain the spring clamp; the central wall having a notch and positioned within the central wall so that a shirt button on the shirt collar is disposed within the notch during engagement of the spring clamp to the shirt collar;

the slotted arm of the main body member being an inner slotted arm extending across the central wall, the main body member further including an outer slotted arm extending across the central wall disposed at a position below the inner slotted arm, a gap being disposed between the inner and outer slotted arms for receiving the legs of the spring clamp, the inner slotted arm extending forward from the central wall and the outer slotted arm positioned from the central wall so that the legs of the spring clamp are disposed relative to the central wall by an angle substantially between 10 and 40 degrees.

5. The assembly of claim 4, wherein the inner slotted arm is a U-shaped arm extending across a front of the central wall to define at least a portion of the notch.

6. The assembly of claim 5, wherein the outer slotted arm is a U-shaped arm extending across the front of the central wall to define a second portion of the notch.

7. A necktie knot support assembly for supporting a pre-tied knotted necktie, said assembly comprising:

a spring clamp adapted to engage a shirt collar; and a main body member shaped to determine formation of the knot of the necktie, the main body member having a substantially vertical central wall and first and second wings extending outward from the central wall; said central wall having a slotted arm extending across the central wall and adapted to inter-engage and retain the spring clamp; the central wall having a notch and positioned within the central wall so that a shirt button on the shirt collar is disposed within the notch during engagement of the spring clamp to the shirt collar; the central wall of the main body member including a second notch disposed within a front of the central wall and positioned so that the spring clamp is retained by the slotted arm at an angle relative to the central wall substantially between 10 and 40 degrees.

8. The assembly of claim 7, wherein the first and second wings include respective substantially flat inner walls extending from the central wall at positions sufficiently separated from one another to allow the shirt button on the shirt collar to be disposed between said positions.

9. A necktie knot support assembly for supporting a pre-tied knotted necktie, said assembly comprising:

a spring clamp adapted to engage a shirt collar, the spring clamp including a clamp arm and legs swingably attached to the clamp arm; and a main body member shaped to determine formation of the knot of the necktie, the main body member having a substantially vertical central wall and first and second wings extending outward from the central wall; said central wall having a slotted arm extending across the central wall and adapted to inter-engage and retain the spring clamp; the central wall having a front notch positioned within a front of the central wall to receive an end of the spring clamp so that the spring clamp is retained by the slotted arm at an angle relative to the central wall substantially between 10 and 40 degrees; the slotted arm of the main body member being an inner slotted arm extending across the central wall, the main body member further including an outer slotted arm extending across the central wall disposed at a position below the inner slotted arm, a gap being disposed between the inner and outer slotted arms for receiving the legs of the spring clamp, the inner slotted arm extending forward from the central wall and the outer slotted arm positioned from the central wall to further facilitate the angle of the spring clamp relative to thee central wall.

10. The assembly of claim 9, wherein the inner slotted arm is a U-shaped arm extending across a front of the central wall to define at least a portion of a rear notch positioned to receive a shirt button on the shirt collar during engagement of the spring clamp to the shirt collar.

11. The assembly of claim 10, wherein the outer slotted arm is a U-shaped arm extending across the front of the central wall to define a second portion of the rear notch.

12. A necktie knot support assembly for supporting a pre-tied knotted necktie, said assembly comprising:

a spring clamp adapted to engage a shirt collar; and a main body member shaped to determine formation of the knot of the necktie, the main body member having a substantially vertical central wall and first and second wings extending outward from the central wall; said central wall having a slotted arm extending across the central wall and adapted to inter-engage and retain the spring clamp; the central wall having a front notch positioned within a front of the central wall to receive an end of the spring clamp so that the spring clamp is retained by the slotted arm at an angle relative to the central wall substantially between 10 and 40 degrees; the central wall of the main body member including a rear notch disposed within an upper portion of the central wall of the main body member and positioned so that a shirt button on the shirt collar is disposed within the notch during engagement of the spring clamp to the shirt collar.

13. The assembly of claim 12, wherein the main body member includes a post rearwardly extending outwards from the central wall at a position disposed below the rear notch.

14. The assembly of claim 9, wherein the first and second wings include respective substantially flat inner walls extending from the central wall at positions sufficiently separated from one another to allow a shirt button on the shirt collar to be disposed between said positions during engagement of the spring clamp to the shirt collar.

* * * * *